US005821470A

United States Patent [19]

Meyer et al.

[11] Patent Number: 5,821,470

[45] Date of Patent: Oct. 13, 1998

[54] BROADBAND ACOUSTICAL TRANSMITTING SYSTEM

[75] Inventors: John D. Meyer, Berkeley; Paul J. Kohut, Pacheco, both of Calif.

[73] Assignee: Meyer Sound Laboratories Incorporated, Berkeley, Calif.

[21] Appl. No.: 824,682

[22] Filed: Apr. 8, 1997

[51] Int. Cl.[6] ..... H05K 5/00

[52] U.S. Cl. ..... 181/155; 181/144; 181/152; 381/99

[58] Field of Search ..... 181/144, 147, 181/145, 152, 153, 155, 156, 199; 381/97, 98, 99, 100, 156, 160, 182, 184, 186

[56] References Cited

U.S. PATENT DOCUMENTS

| | | | |
|---|---|---|---|
| D. 357,678 | 4/1995 | Meyer . | |
| 4,152,552 | 5/1979 | Meyer | 181/159 X |
| 4,243,840 | 1/1981 | Kates | 381/100 |
| 4,357,490 | 11/1982 | Dickey | 181/155 X |
| 4,771,466 | 9/1988 | Modafferi | 381/99 |
| 4,965,837 | 10/1990 | Murayama et al. | 181/155 X |
| 5,086,871 | 2/1992 | Barbe | 181/155 X |
| 5,185,801 | 2/1993 | Meyer et al. | 381/97 X |
| 5,532,438 | 7/1996 | Brown . | |

OTHER PUBLICATIONS

Meyer Sound Catalog Sheet, 1993 Accoustical Ranging Transceiver System.

*Primary Examiner*—Khanh Dang
*Attorney, Agent, or Firm*—Donald L. Beeson

[57] ABSTRACT

An acoustical transmitting system and method for producing a narrow beam of acoustic energy over a broadband operating frequency range utilizes a parabolic reflector dish, a horn-loaded compression driver for directing acoustic energy toward the dish's reflecting surface, and a low frequency driver mounted behind a central aperture in the dish for producing acoustic energy that combines and interacts with the reflected acoustic energy produced by the horn-loaded compression driver. An input signal processing circuit is provided to condition the audio signal to the horn-loaded compression driver and the low frequency driver to achieve on-axis gain and off-axis cancellations at low frequencies. The addition of the low frequency driver to the reflector dish system effectively extends the ability of the system to produce and transmit acoustic energy in a narrow distribution pattern at frequencies below 1000 Hz using a four foot diameter dish.

19 Claims, 8 Drawing Sheets

| X | 1 | 2 | 3 | 4 | 5 |
|---|---|---|---|---|---|
| Y | 1.15 | 1.40 | 1.70 | 2.10 | 2.80 |

BROADBAND ACOUSTICAL TRANSMITTING SYSTEM

BACKGROUND OF THE INVENTION

The present invention generally relates to sound reinforcement systems, and more particularly to directional loudspeaker systems and techniques for supplying reinforced sound to locations at substantial distances from the original sound source.

Sound reinforcement is used in a wide variety of indoor and outdoor venues, including, for example, theaters, indoor arenas, stadiums and outdoor areas where performances or activities using sound amplification take place. The design of a sound reinforcement system will depend on a variety of factors including the size of the venue, the location and distribution of the audience within the venue, the presence or absence of reflective surfaces and the location of those surfaces, and the presence of special seating areas where coverage may be difficult, such as balcony and under-balcony seating areas. In larger venues and venues having seating areas such as balcony and under-balcony seating, delay speakers and delay lines are frequently employed to achieve adequate coverage. Generally speaking, the greater the size of the venue, the greater the power requirements are for the loudspeaker system.

There are a number of difficulties in designing sound reinforcement systems that have good coverage and perform well throughout the venue. First is the difficulty of producing acoustic energy at adequate power levels at all audience locations. Distant and hard to reach locations frequently need to be served by nearby delay speakers which supplement the acoustic power received from the primary speaker system. Another difficulty relates to the undesired interaction between sound waves from two or more physically separated loudspeakers or from two or more physically separated drivers within the same loudspeaker. Such interaction can create dead spots and interference patterns including a phenomenon called "combing," where a speaker acts like a comb filter as the listener moves away from the speaker's axis. Yet another difficulty relates to the objective of minimizing reflections from reflective surfaces within the venue.

A further problem frequently encountered in outdoor venues relates to the difficulty of confining the sound to the intended audience, with the result that the amplified sound spills into surrounding areas, for example, residential neighborhood surrounding an outdoor theater. Attempts to adjust sound levels to avoid neighbor complaints normally compromises the efficiency of the sound system in terms of covering its intended audience. Related problems can occur in indoor venues where separate activities take place in adjacent areas which are not acoustically isolated, for example, in a multiplex theater.

Therefore, a need exists for a highly directional loudspeaker system capable of directing a narrow beam of sound to a precise location or locations within a venue without the sound spilling into regions outside of the directional sound beam. Such a speaker system would permit a greater amount of the available acoustic energy generated by the loudspeaker system to be utilized for its intended audience, and could be used to avoid interference problems associated with the overlapping of speaker distribution patterns and problems associated with off-axis interference such as "combing." While directional loudspeakers are known, such loudspeakers still have a relatively broad distribution pattern which can lead to overlapping and resulting interference problems. Conventional loudspeakers also usually produce significant off-axis side lobes at certain frequencies which can degrade the overall performance of the system.

It is also known to produce narrow beams of acoustic energy using parabolic reflectors, wherein acoustic energy is directed to a parabolic reflector dish from a horn-loaded compression driver positioned in front of the dish. Such reflector systems are effective in producing very narrow beams of acoustic energy within narrow frequency ranges. However, the directionality of such transmitters tends to degrade markedly below a certain threshold frequency which is related to the size of the transmitter's components. For practically-sized components, it has been found that prior art parabolic dish reflector systems tend to produce undesirable side lobes at frequencies below approximately 1000 Hz. This makes such systems unsuitable for most sound reinforcement applications.

The present invention provides an acoustical transmitting system which utilizes the ability of a reflector dish to direct acoustic energy in a highly directional fashion and which extends the effectiveness of the dish at low frequencies, that is, at frequencies generally below 1000 Hz for practically-sized components. The invention particularly provides a broadband acoustical transmitting system capable of producing high acoustical power levels in a highly directional polar pattern over an extended operating frequency range, for example, between 500 Hz and 14,000 Hz, thus providing the ability to project amplified sound, such as voice and music, in a narrow beam to precise locations at substantial distances from the transmitting system. The acoustical transmitting system of the invention can be used to reduce undesirable reflections, off-axis combing effects, and interference problems associated with speaker overlap. It can further eliminate the need for delay speakers and delay lines, and permits sound amplification to be used in indoor and outdoor venues without disturbing neighboring areas.

SUMMARY OF THE INVENTION

Briefly, the present invention involves an acoustical transmitter apparatus for a broadband acoustical transmitting system which utilizes a reflector dish having a front concave, preferably parabolic, reflecting surface and a forward radiant axis. A first acoustical transducer means positioned in front of the concave reflecting surface of the reflector dish produces acoustic energy within the operating range of the transmitting system and directs this energy toward the dish's reflecting surface. The reflecting surface of the dish, in turn, acts to reflect the acoustic energy received from the first transducer means in a directional polar pattern about the dish's radiant axis. Normally, this polar pattern would degrade at lower frequencies within the desired operating frequency range of the system.

However, in accordance with the invention, a second acoustical transducer means is also provided for producing acoustic energy in the low range of the operating frequency range of the transmitting system and for counteracting the degradation of the directional characteristics of the reflector dish at such frequencies. The second acoustical transducer means is positioned relative to the reflector dish for producing acoustic energy from a second position relative to the dish which causes the acoustic energy produced thereby to radiate from the dish's reflecting surface in a solar pattern about the dish's radiant axis and which results in an acoustic path length difference between the acoustic energy produced by the first transducer means and that produced by the second transducer means. Preferably, the second transducer means produces acoustic energy from a position that is substantially coincident with the dish's reflecting surface.

In its preferred embodiment, the first transducer means is a horn-loaded compression driver positioned substantially on the radiant axis of the reflector dish and the second transducer means is a low frequency driver mounted behind a center aperture in the dish such that it is also substantially aligned with the dish's radiant axis.

An input signal processing circuit is provided to condition the electrical signals fed to the first and second transducer means such that the acoustic energies produced by these transducers will interact and combine to extend low frequency range of the transmitting system. This circuit has a high frequency channel connected to the first transducer means and a low frequency channel connected to the second transducer means. The high frequency channel includes high-pass filter means for rolling off the amplitude response of the first transducer means within the low frequency range in which the second transducer means operates. The low frequency channel in turn includes a band-pass filter means for limiting the operating frequency range of the low frequency driver to a controlled band-pass frequency range. To be effective, it is found that the band-pass filter means in the low frequency channel should limit the band-pass frequency range of the low frequency driver to about one-half octave.

The low frequency channel can also include an all-pass filter means having a center frequency located above the operating range of the second transducer means such that the second transducer means operates within the skirt of the all-pass filter. The all-pass filter will permit the phase of the acoustic signal produced by the second transducer means to be manipulated such that it combines and interacts in the desired fashion with the acoustic signal produced by the first transducer means.

The invention also involves a method of using a reflector dish to project acoustic signal in a narrow distribution pattern over a broadband operating frequency range which includes a defined low frequency range. The method includes the steps of producing acoustic energy within a desired operating frequency range from a first position in front of a concave reflecting surface of the reflector dish, and directing this acoustic signal toward the dish's reflecting surface such that the acoustic signal is reflected in a directional polar pattern about the forward radiant axis of the reflector dish. The method further includes producing acoustic energy in the low frequency portion of the operating frequency range from a second position located at or relative to the reflecting surface of the reflector dish such that the acoustic energy produced from this second position is radiated from the dish's reflecting surface in its own polar pattern about the dish's radiant axis. Finally, the method provides for controlling the phase and amplitude of the acoustic energy produced from such first and second positions such that the acoustic energy from each position combine and interact to produce an enhanced directional polar pattern within the low frequency portion of the desired operating frequency range.

Therefore, it can be seen that it is an object of the invention to provide an acoustical transmitting system capable of producing a relatively narrow sound beam over a broad operating frequency range. It is another object of the invention to provide an acoustical transmitting system which permits a sound designer to direct most of the available acoustic energy produced by the system to desired audience locations. It is a further object of the invention to provide an acoustic transmitting system which substantially eliminates unwanted side lobes produced by a conventional reflector system at low frequencies. It is yet a further object of the invention to provide such an acoustic transmitting system in a relatively compact configuration that is easily transportable. Other objects of the invention will be apparent from the following specification and claims.

DESCRIPTION OF THE ILLUSTRATED EMBODIMENT

Figure 1:
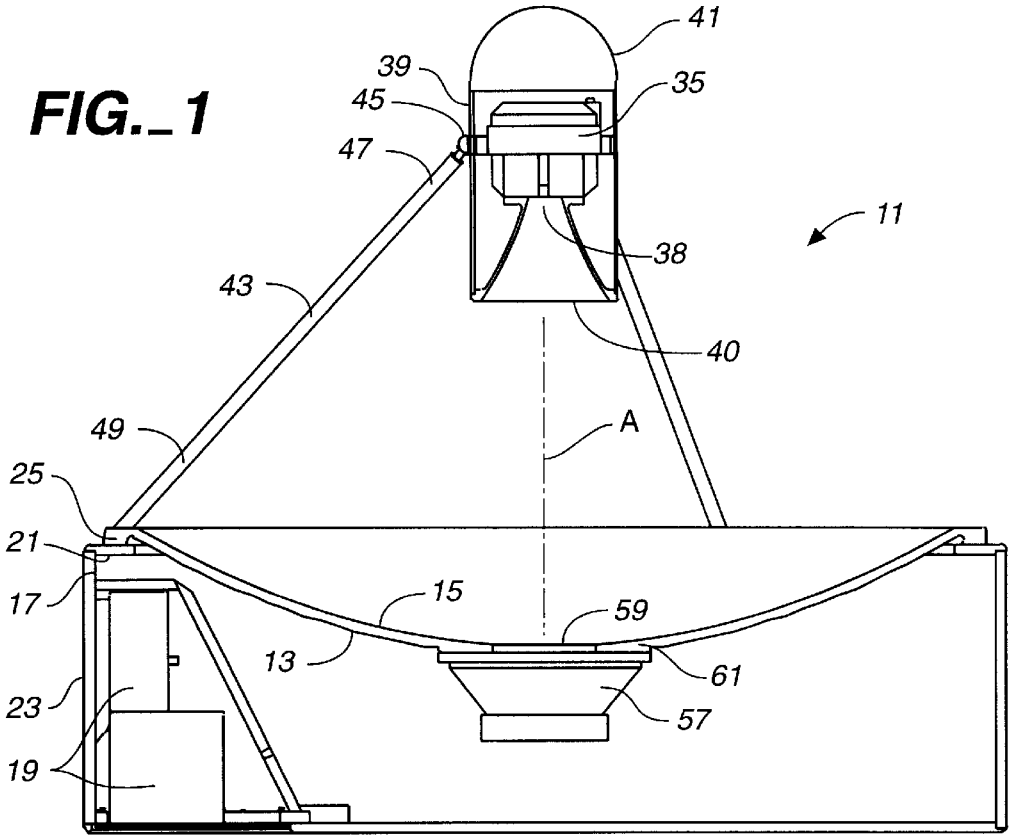
FIG. 1 is a side elevational view, in cross-section, of an acoustical transmitter apparatus in accordance with the invention taken along section lines 1—1 in FIG. 3.
Figure 2:
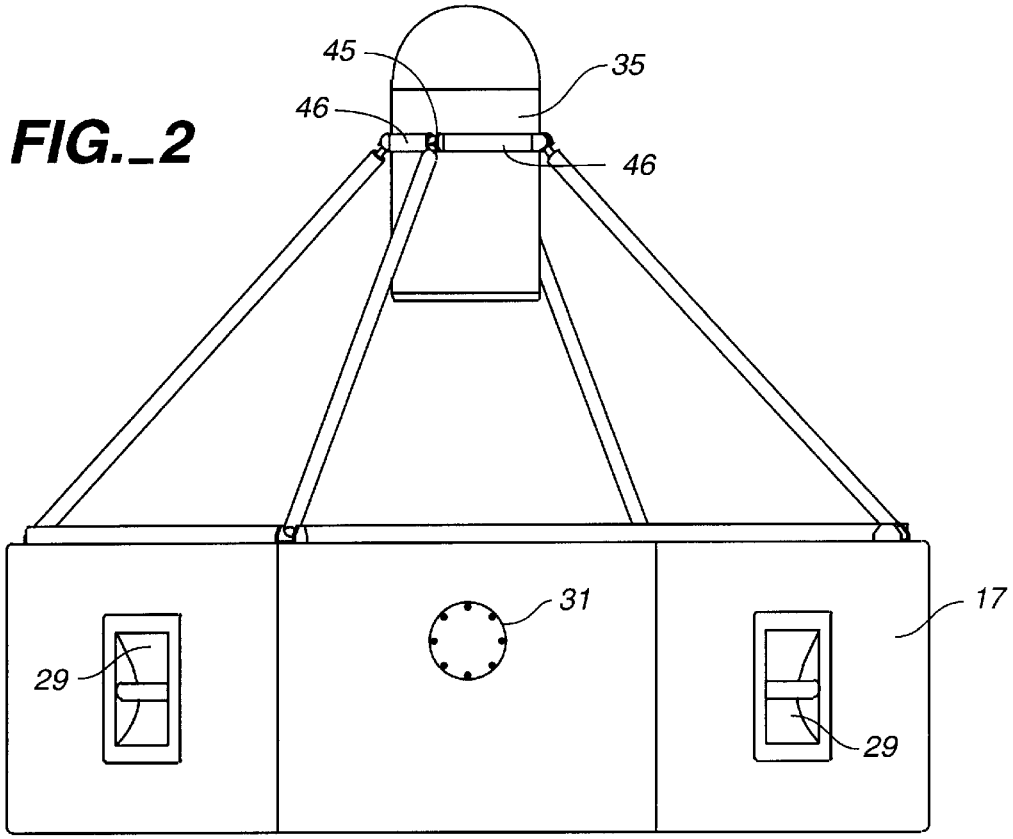
FIG. 2 is another side elevational view of an acoustical transmitter apparatus in accordance with the invention, showing the cabinet therefor.
Figure 3:
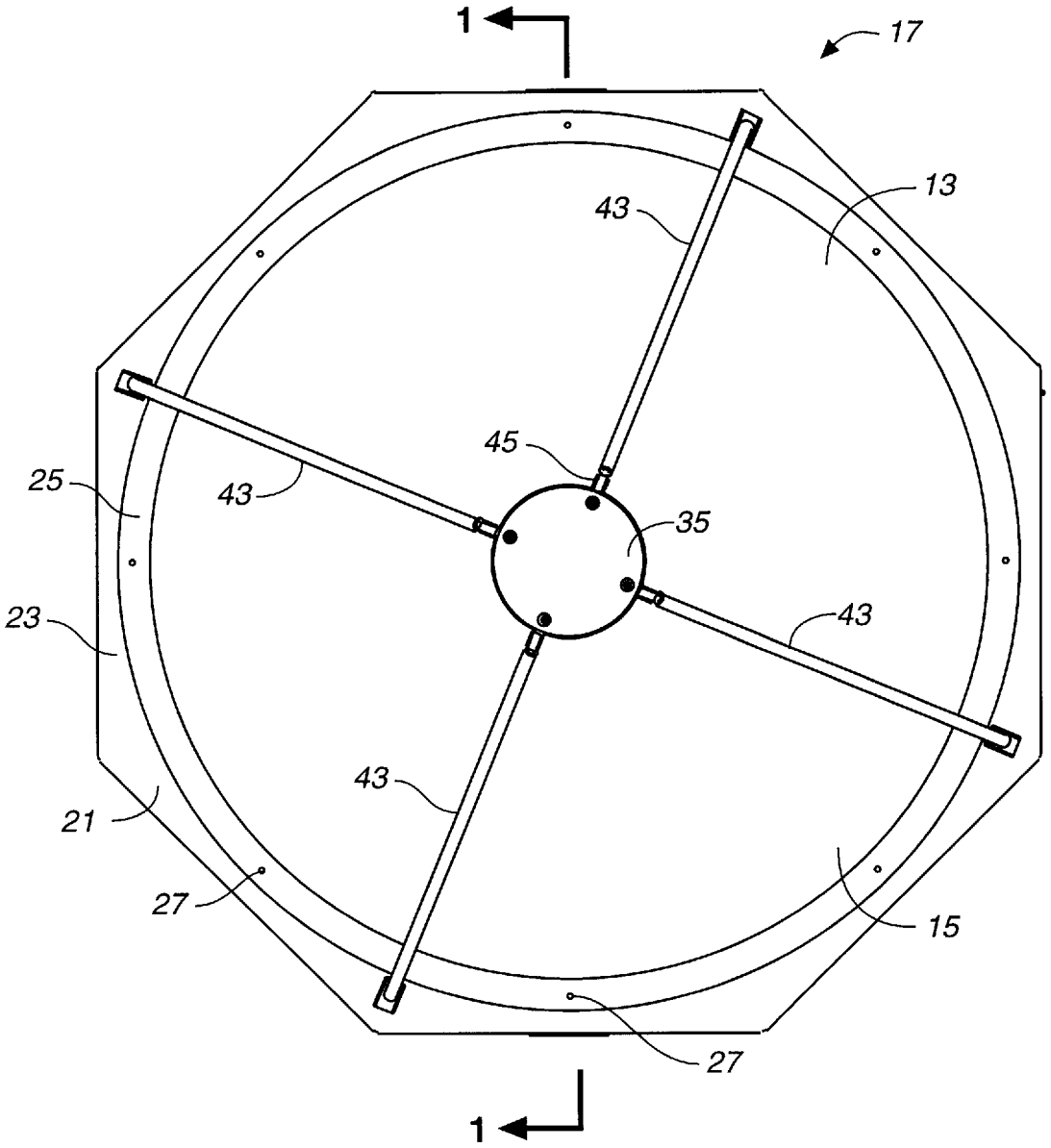
FIG. 3 is a top plan view of the acoustical transmitter apparatus illustrated in FIGS. 1 and 2.
Figure 4:
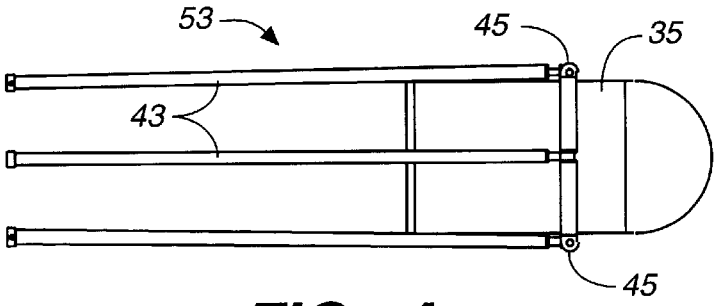
FIG. 4 is a side elevational view of the detachable compression driver assembly of the invention, showing the support posts therefor collapsed into a stowable position.
Figure 5:
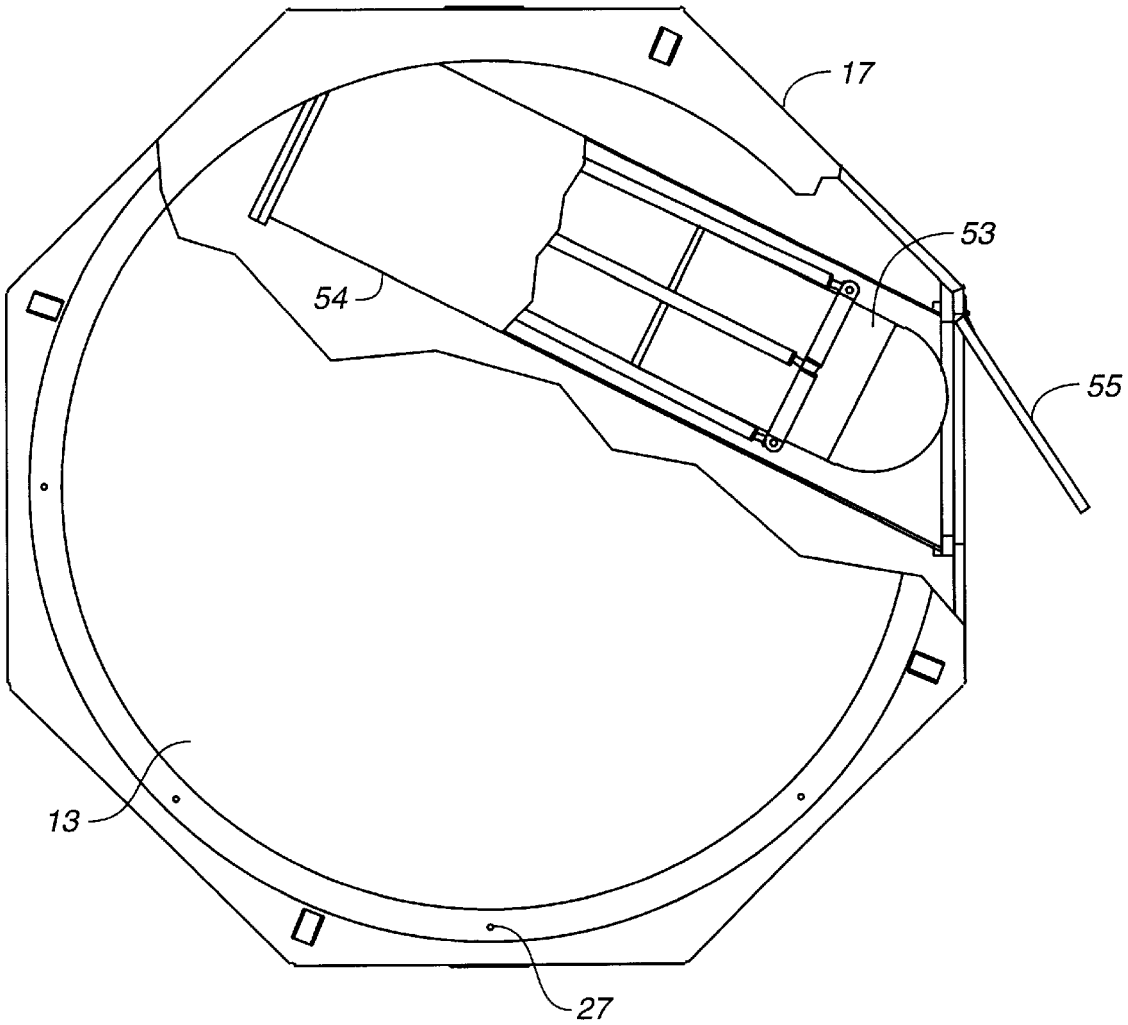
FIG. 5 is a cut-away, top plan view of the acoustical transmitter apparatus illustrated in FIG. 3, showing how the detachable compression driver assembly can be stowed in the cabinet thereof.

Referring now to the drawings, FIGS. 1–3 show an acoustical transmitter apparatus 11 assembled in its operative configuration, whereas FIGS. 4 and 5 show the same apparatus broken down for storage and shipment. This apparatus together with the input signal processing circuit described below provides an acoustical transmitting system capable of projecting acoustic energy in a very narrow distribution pattern over a relatively broadband width. It is contemplated that the transmitter apparatus of the invention can be constructed which is relatively compact and which can operate at frequencies ranging from approximately 500 Hz to approximately 14,000 Hz, without significant degradation in the directional characteristics of the system at most frequencies.

Referring to FIGS. 1–3, transmitter apparatus 11 includes a reflector dish 13 having a concave reflecting surface 15 which is preferably a parabolic surface fabricated of a hard reflective material such as a suitable fiberglass composition. The reflector dish also has a forward radiant axis denoted by the letter "A" in FIG. 1, and sets into a relatively narrow, polygon-shaped cabinet 17, which houses electronic modules 19 containing the system's signal processing circuity, amplifier, and power supply as hereinafter described. To support the reflector dish, cabinet 17 has a narrow upper support ledge 21 extending inwardly from the top of the cabinet side walls 23. This support ledge supports the reflector dish along its outer perimeter rim 25, with the dish's outer perimeter rim being removably secured to the ledge by suitable screw attachments 27 as shown in FIG. 3. Cabinet 17 is also provided with suitable lifting handles 29 and rigging points 31 to facilitate handling and installing of the system.

As best seen in FIG. 1, the transmitter apparatus 11 additionally includes two separate acoustical transducer means positioned relative to the reflector dish 13. The first transducer means is in the form of a horn-loaded compression driver 35 positioned in substantial alignment with the dish's radiant axis A, such that, the horn 37 having a throat end 38 and mouth end 40 directs acoustic energy produced by the driver toward the dish's reflecting surface 15. The horn-loaded compression driver 35 is mounted in a cylindrically shaped housing 39 having a dome-shaped projecting end 41, and is supported in its operative position above cabinet 17 by means of four support posts 43. Hinge joints 45 formed by the bent ends of strap segments 46 are provided on the sidewalls of the driver housing 39 such that the top ends 47 of support posts 43 can be hingedly connected to the housing to form a collapsible and stowable driver assembly 53. The bottom ends 49 of the support posts are, in turn, removably attachable to the top of the cabinet at the cabinet's upper support ledge 21 using suitable attachment hardware (not shown) provided on top of the support ledge.

FIGS. 4 and 5 show how the driver assembly 53, consisting of the compression driver 35 and hinged support posts 43, can easily be stowed in the cabinet 17. By simply detaching the bottom ends 47 of the support posts 43 from the cabinet, the posts can be hinged to the collapsed position shown in FIG. 4. The assembly 53 can then be stowed in a storage cavity 54 provided in the cabinet behind access door 55 located in the cabinet's sidewall.

The second transducer means of transmitting apparatus 11 is provided in the form of low frequency cone driver 57 positioned such that it emits acoustic energy from the reflecting surface 15 of the reflector dish in a polar pattern about the dish's radiant axis. Specifically, the reflector dish 13 is provided with a center aperture 59 which is aligned with the dish's radiant axis. A low frequency driver 57 is mounted behind this aperture to a mounting platform 61 formed on the back of the dish. Due to the position of this second driver, an acoustic path length difference will exist between the paths of the acoustic energy produced by each driver and any arrival point in front of the dish. The acoustical path length differences can be used to the following advantage: they can be used to provide on-axis acoustical power gain in the low frequency range of the acoustical transmitting system, while canceling naturally occurring side lobes within this range. To achieve these desired effects, the audio signal inputs to the compression driver 35 and low frequency driver 57 must first be conditioned by a suitable signal processing circuit.

Figure 6:
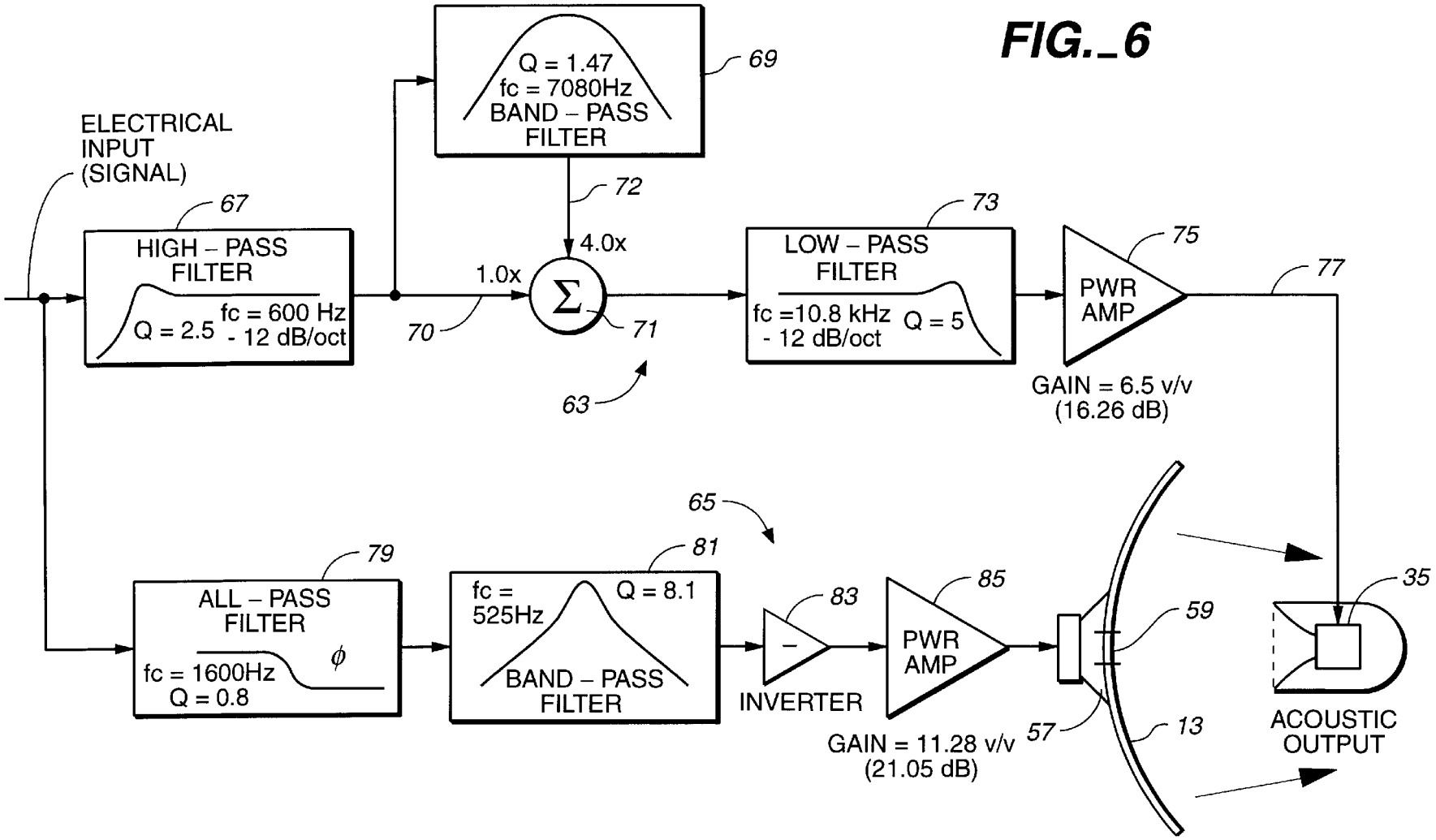
FIG. 6 is a block diagram showing a signal processing circuit for the acoustical transmitting system of the invention.

FIG. 6 shows a signal processing circuit for conditioning the audio signal inputs to the two drivers illustrated in FIG. 1. The input signal processing circuit shown in FIG. 7 includes a high frequency channel 63 connected to the compression driver 35 which is positioned in front of reflector dish 13, and a low frequency channel 65 connected to the low frequency driver 57 mounted behind aperture 59 of the reflector dish. In the high frequency channel, the circuit includes a second order high-pass filter 67 for rolling off the frequency response of the compression driver in the low frequency range of the transmitting system at a rate of 12 dB per octave. This high-pass filter will prevent overdriving of the compression driver at low frequencies, and will also control the contributions from this driver to an acoustic output of the transmitting system within the low frequency range of the system. The high frequency channel 63 is additionally provided with equalization to shape the frequency response of the system in the upper frequency ranges. Such equalization is provided by a parametric equalization circuit including band-pass filter 69 and summing node 71, and a low-pass filter 73 which adds gain to the system at the high end of its frequency range. Suitable amplification is provided in the high frequency channel by means of power amp 75, the output 77 of which is connected to compression driver 35.

The circuit's low frequency channel 65 conditions the signal input to driver 57 such that the acoustical output of this driver provides on-axis gain within the low frequency range of the transmitting system, and off-axis cancellations within this frequency range. Low frequency channel 65 includes all-pass filter 79, band-pass filter 81, invertor 83, and power amp 85, the output 87 of which is connected to the low frequency driver 57. The band-pass filter 81, which is preferably a second order filter, has a center frequency within the desired operating range of the low frequency driver 57 and provides desired gain within this operating range. It also limits the amplitude response of the low frequency driver to a predetermined operating frequency range within the low frequency range of the transmitting system. To achieve desired off-axis cancellation, band-pass filter 81 should preferably limit the operating frequency range of the low frequency driver to a range of no greater than one-half octave. Allowing the low frequency driver to operate over more than one-half octave has been found to be detrimental to the desired objective of off-axis cancellations.

The low channel's all-pass filter 79 provides a means for manipulating the phase of the acoustic output from driver 57 to achieve desired off-axis cancellations with the reflected acoustic power produced by the compression driver 35. Phase manipulation is achieved by allowing the low frequency driver to operate on the skirt of the all-pass filter. The center frequency of the filter should thus be above the low driver's operating frequency range.

The parameters of the input signal processing circuit illustrated in FIG. 6 will be chosen based on the operating characteristics of the transmitter apparatus 11 and its individual components, namely, the compression driver 35, dish reflector 13, and low frequency driver 57. The starting point in this design is the selection of a dish size of practical dimensions, choosing drivers 35, 57, and then selecting a design for the horn 37 which is suitable to the dish design and the desired operating parameters of the system. At higher frequencies the horn design and placement will be critical to the polar pattern of the system, and thus careful attention must be given to the horn design and placement in order to achieve a broadband directional system. Such design and placement is accomplished empirically by measuring the polar response at frequencies above the low frequency range of the system (for example, above approximately 1000 Hz for a 4 foot diameter dish) with different horn designs and placements until an optimum solution is found, that is, until optimum directionality is achieved within the upper frequency range of the system (for example, between approximately 1000 Hz and 14,000 Hz).

Once the dish and drivers have been selected and the horn design is finalized, the signal processing circuit can be designed to achieve a desired result in the low frequency range of the system. Such a design process is an iterative process involving measuring the individual components of the transmitter apparatus and selecting the signal processing circuit parameters to achieve a desired overall result, that is, optimum directionality over the entire operating range of the transmitter system, which in the operating example given below, is about 500 Hz to 14,000 Hz.

OPERATIVE EXAMPLE

An operative example of an acoustical transmitting system in accordance with the invention is now described in connection with the reflector dish 13 having the following physical characteristics:

| | | |
|---|---|---|
| dish diameter | 4 feet | |
| equation for parabolic curve of reflecting surface | $y = x^2/81$ | for x = 0 to 24" |

Using the above dish design, an operative system having the following physical characteristics and circuit parameters has been constructed:

Physical Characteristics

Figures 7, 7A:
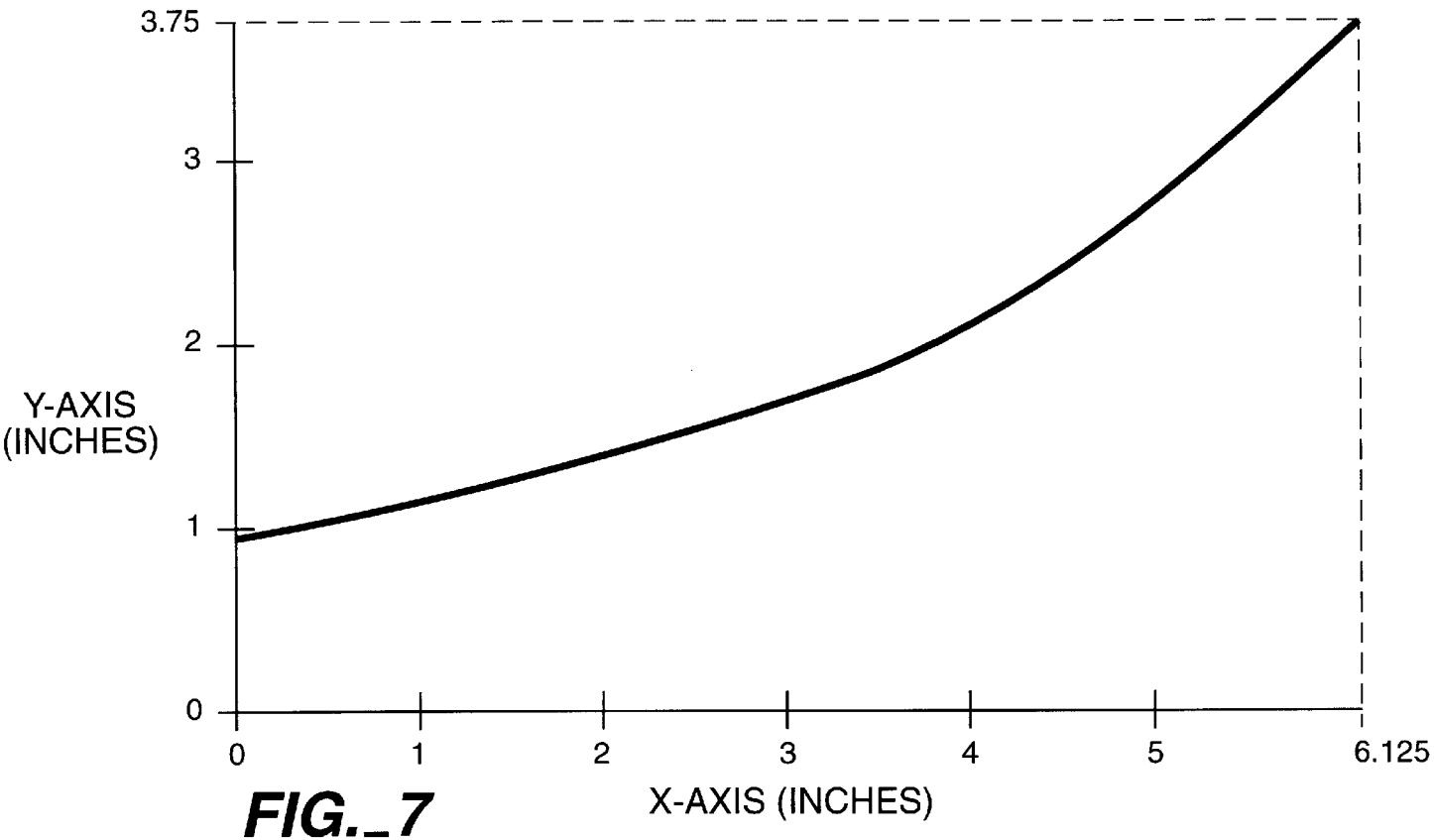
FIG. 7 is a plot of the flare of the horn used on the compression driver of the described operative embodiment of the present invention, wherein x=0 is the throat of the horn and x=6.125 is the mouth of the horn.
FIG. 7A is a table showing the values of the y-coordinates for the flare of the horn shown in FIG. 7 for five integer x-coordinate values between the throat (x=0) and mouth (x=6.125) of the horn.

| | |
|---|---|
| Diameter of dish aperture (59) | 6 inches |
| Distance from dish reflecting surface (15) to mouth of horn (37) | 20 1/4 inches ± 1/4 inch |
| Horn | |
| Throat diameter (at 38) | 1.9 inches |
| Mouth diameter (at 40) | 7.5 inches |
| Depth | 6.125 inches |
| Flare | in accordance with curvature shown in FIG. 7 and table in FIG. 7A |
| Tolerance | ±0.1 inches |

Selection of Driver Components

Figure 8:
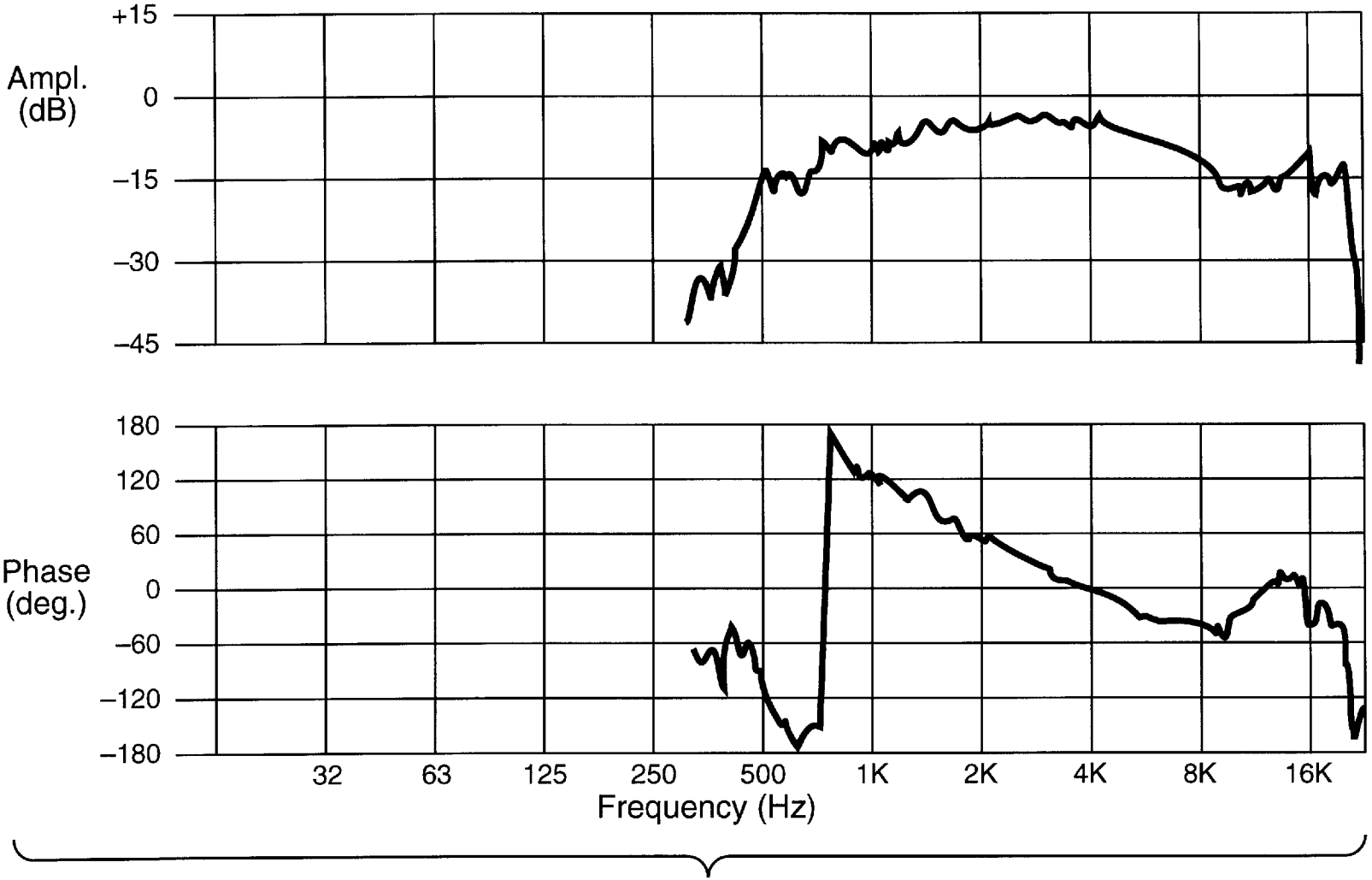
FIG. 8 is a phase and amplitude response curve of a horn-loaded compression driver used in the described operative embodiment of the invention.
Figure 9:
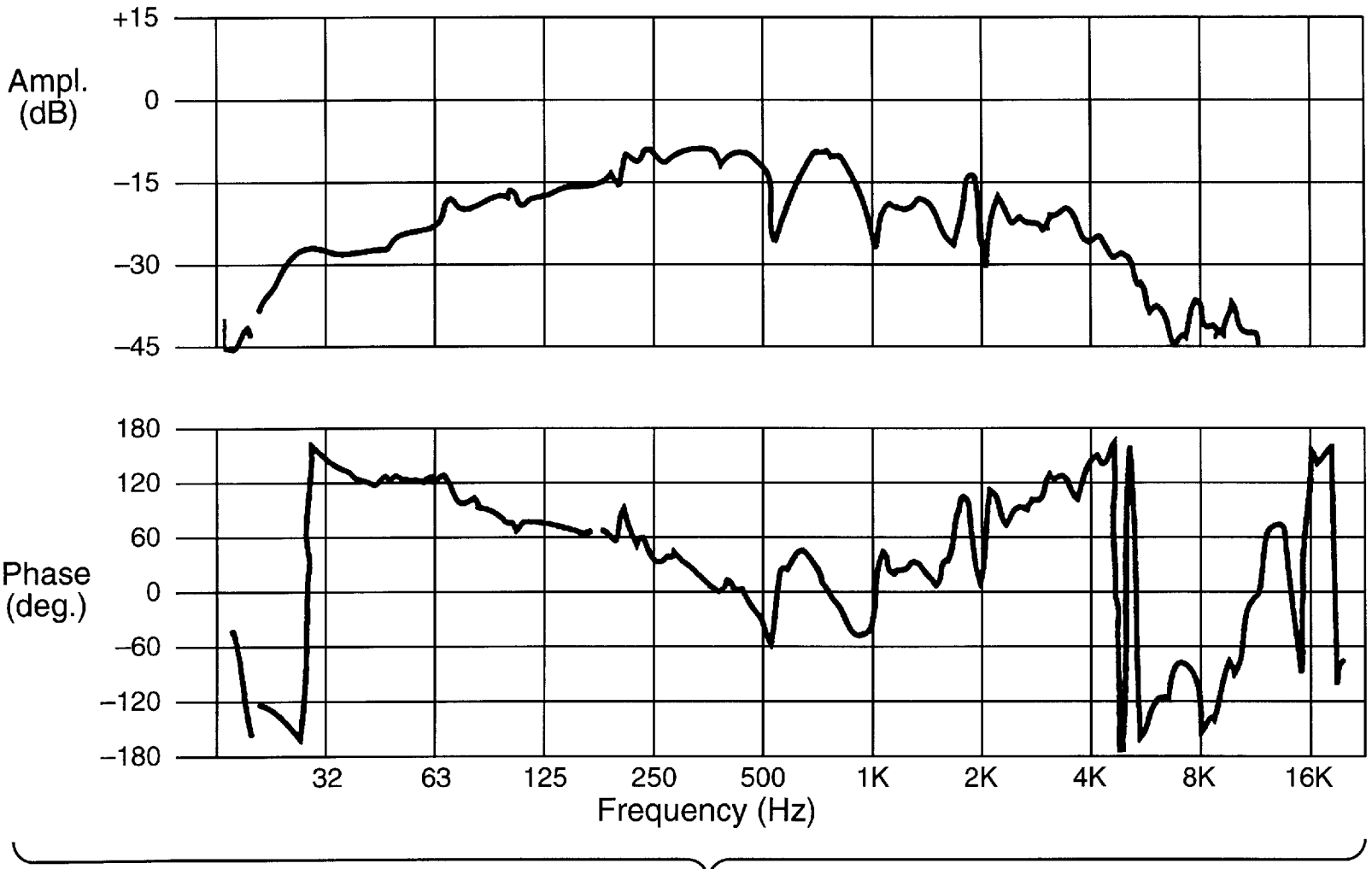
FIG. 9 is a phase and amplitude response curve for the low frequency cone driver used in the described operative embodiment of the invention.

| | |
|---|---|
| Horn-loaded compression driver (35) | exhibits amplitude and phase characteristics shown in FIG. 8 when measured at 1 meter |
| Low frequency driver (57) | 12 inch cone driver having amplitude and phase characteristics shown in FIG. 9, measured at 1 meter |

Signal Processing Circuit Parameters—High Frequency Channel

| | |
|---|---|
| High-pass filter (67) | second order<br>cut-off frequency = 600 Hz<br>Q = 2.5 |
| Band-pass filter (69) | second order<br>center frequency = 7,080 Hz<br>Q = 1.47 |
| Summing at node (71) | gain of X 1 for direct signal (70)<br>gain of X 4 for band-pass signal (72) |

-continued

| | |
|---|---|
| Low pass filter (73) | second order<br>cut-off frequency = 10.0 kHz<br>Q = 5 |
| Power amp (75) | gain = 6.5 v/v (15.26 dB) |

Signal Processing Circuit Parameters—Low Frequency Channel

| | |
|---|---|
| All-pass filter (79) | second order<br>center frequency = 1600 Hz<br>Q = 0.8 |
| Band-pass filter (81) | second order<br>center frequency = 525 Hz<br>Q = 8.1 |
| Power amp (85) | gain = 11.28 v/v (21.05 dB) |

The above described transmitter system will have a frequency range of approximately 500 Hz to 14,000 Hz, with the presence of the low frequency driver effectively extending the operating range of the system from approximately 1,000 Hz down to 500 Hz, that is, by one octave. The tolerances for the horn spacing and design are provided to indicate the relative sensitivity of the polar response to the construction and placement of the horn.

Figure 10:
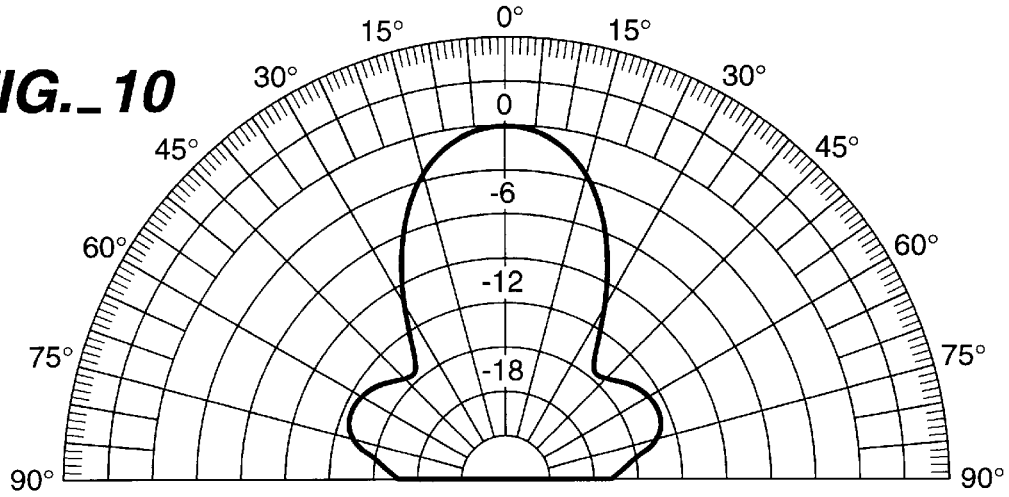
FIG. 10 is a polar plot of the amplitude response of the described operative embodiment of the invention at 500 Hz using the horn-loaded compression driver only.
Figure 11:
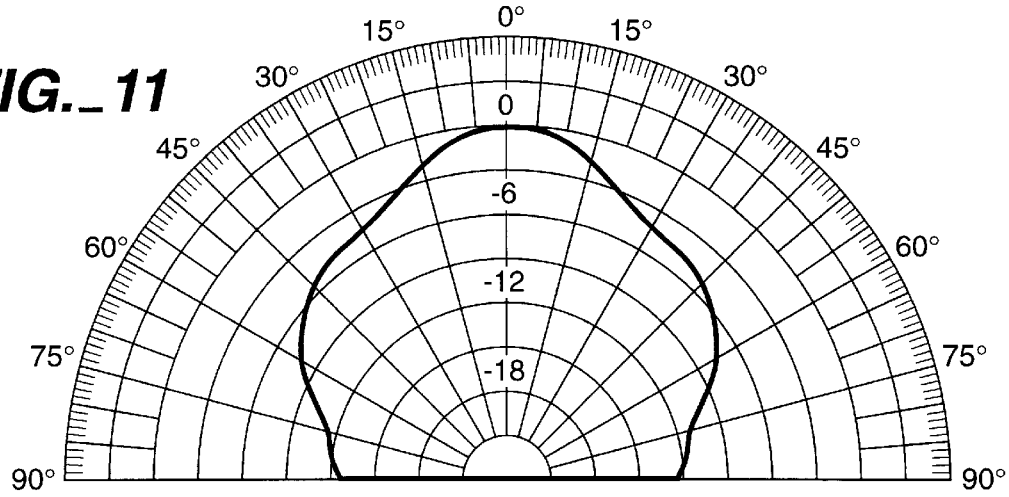
FIG. 11 is a polar plot of the amplitude response thereof at 500 Hz using the low frequency driver only.
Figure 12:
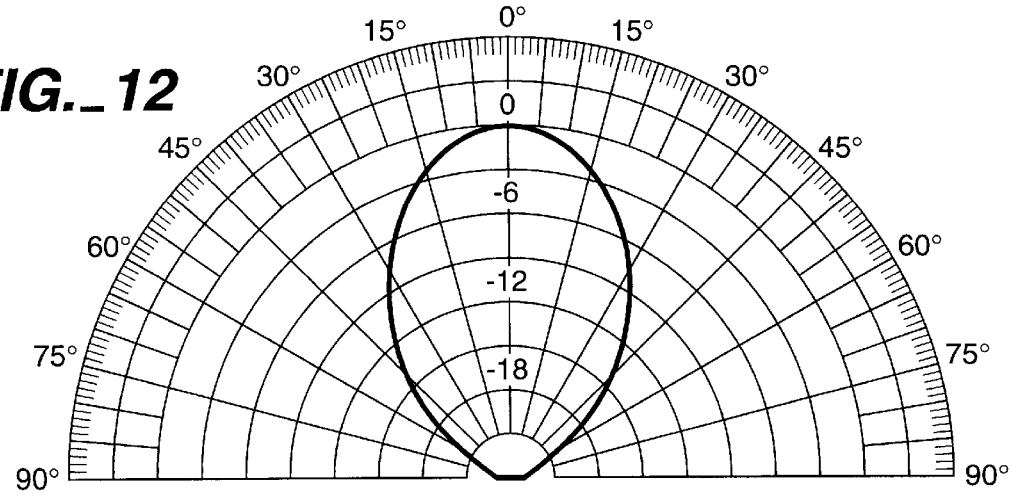
FIG. 12 is a polar plot of the amplitude response thereof at 500 Hz using both the horn-loaded compression driver and low frequency driver.

FIGS. 10–12 show three polar patterns of the system components and composite system described above taken at 500 Hz, which illustrate the interaction between the acoustic energy produced by the two drivers of the system. Specifically, FIG. 11 shows the measured polar pattern of the 4 foot dish 13 and horn-loaded driver 35 at 500 Hz without the low frequency driver 57. FIG. 12 illustrates the polar pattern of a reflector dish 13 and low frequency driver 57 at 500 Hz without the horn-loaded compression driver 35. FIG. 13, on the other hand, shows the measured composite polar pattern at 500 Hz of the compression driver and low frequency driver operating together. It can be seen that the side loads produced at 500 Hz by the horn-loaded compression driver is effectively eliminated by the introduction of the low frequency driver.

Therefore, it can be seen that the present invention provides an apparatus, system and method for producing acoustical energy in a relatively narrow distribution pattern over a broad operating bandwidth. While the invention has been described in considerable detail in the foregoing specification, it is understood that it is not intended that the invention be limited to such detail except as necessitated by the following claims.

What we claim is:

1. An acoustical transmitter apparatus for a broadband acoustical transmitting system which is operative to project acoustic energy in a directional polar pattern over an operating frequency range which includes a defined low frequency range, said acoustical transmitter apparatus comprising a reflector dish having a front concave reflecting surface and a forward radiant axis, first acoustical transducer means for producing acoustic energy within the operating frequency range of the transmitting system, said first acoustical transducer means being operatively positioned in spaced relation in front of the concave reflecting surface of said reflector dish for directing acoustic energy produced thereby toward said reflecting surface, and said reflecting surface being operative to reflect acoustic energy received from said first acoustical transducer means in a directional polar pattern about said forward radiant axis, and second acoustical transducer means positioned in close proximity to said reflector dish for producing acoustic energy which is emitted from the reflecting surface thereof in a polar pattern about the dish's forward radiant axis, said second acoustical transducer means being operative to produce acoustic energy in the low frequency range of the transmitting system such that the acoustic energies produced by said first and second transducer means combine and interact to produce a composite polar pattern about said forward radiant axis within the low frequency range of the transmitting system, whereby enhanced directionality within such low frequency range can be achieved.

2. The acoustical transmitter apparatus of claim 1 wherein said first acoustical transducer means is positioned in substantial alignment with the radiant axis of said reflecting surface.

3. The acoustical transmitter apparatus of claim 2 wherein said first acoustical transducer means is a horn-loaded compression driver.

4. The acoustical transmitter apparatus of claim 1 wherein said second acoustical transducer means includes a low frequency driver mounted to said reflector dish substantially in alignment with the radiant axis of said reflector dish.

5. The acoustical transmitter apparatus of claim 4 wherein said reflector dish has a center aperture substantially aligned with the dish's radiant axis and wherein said low frequency driver is mounted to said reflector dish behind said aperture so as to emit acoustic energy therethrough.

6. The acoustical transmitter apparatus of claim 1 wherein said first acoustical transducer means includes a horn-loaded compression driver mounted to direct acoustic energy toward the reflecting surface of said reflector dish from a position substantially aligned with the forward radiant axis thereof, and said second acoustical transducer means includes a low frequency driver mounted to said reflector dish substantially in alignment with said forward radiant axis.

7. An acoustical transmitter apparatus for a broadband acoustical transmitting system which is operative to project acoustic energy in a directional polar pattern over an operating frequency range which includes a defined low frequency range, said acoustical transmitter apparatus comprising a reflector dish having a front concave reflecting surface, a center aperture, and a forward radiant axis extending from said center aperture, a horn-loaded compression driver for producing acoustic energy within the operating frequency range of the transmitter apparatus, said horn-loaded compression driver being operatively positioned in front of the concave reflecting surface of said reflector dish for directing acoustic energy produced thereby toward said reflecting surface, and said reflecting surface being operative to reflect acoustic energy received from said compression driver in a directional polar pattern about said forward radiant axis, and a low frequency driver mounted to said reflector dish behind the center aperture thereof for producing acoustic energy which is emitted from said aperture in a polar pattern about the dish's forward radiant axis and which combines and interacts with the acoustic energy from said horn-loaded compression driver to produce a composite polar pattern about said radiant axis within the low frequency range of the transmitting system, whereby enhanced directionality within such low frequency range can be achieved.

8. A broadband acoustical transmitting system for projecting acoustic energy in a directional polar pattern over an operating frequency range which includes a defined low frequency range and which is driven by and electrical input signal, said acoustical transmitting system comprising a reflector dish having a front concave reflecting surface and a forward radiant axis, first acoustical transducer means for producing acoustic energy within the operating frequency range of the transmitting system, said first acoustical transducer means being operatively positioned in front of the concave reflecting surface of said reflector dish for directing acoustic energy produced thereby toward said reflecting surface, said first transducer means having a characteristic amplitude and phase response, and said reflecting surface being operative to reflect acoustic energy received from said first acoustical transducer means in a directional polar pattern about said forward radiant axis, second acoustical transducer means having a characteristic amplitude and phase response and positioned in close proximity to said reflector dish for producing acoustic energy which is emitted from the reflecting surface thereof in a polar pattern about said forward radiant axis and which combines and interacts with the acoustic energy produced by said first transducer means to produce a composite polar pattern about the dish's forward radiant axis, and an input signal processing circuit including a high frequency channel connected to said first transducer means and a low frequency channel connected to said second transducer means, the high frequency channel of said signal processing circuit including high-pass filter means for rolling off the amplitude response of said first transducer means at a predetermined rate within the low frequency range of the transmitting system, and the low frequency channel of said signal processing circuit including band-pass filter means for limiting the amplitude response of said second transducer means to a predetermined band-pass frequency range within the low frequency range of said transmitting system such that the low frequency driver effectively operates within said band-pass frequency range, said input signal processing circuit being operative to control the acoustic energies produced by said first and second transducer means such that they combine and interact within the band-pass frequency range of said second acoustical transducer means to enhance the directionality of the composite polar pattern of the transmitting system.

9. The acoustical transmitting system of claim 8 wherein the band-pass filter means in the low frequency channel of said signal processing circuit limits the predetermined band-pass frequency range of said second transducer means to less than approximately one-half octave centered at a frequency within the low frequency range of the transmitting system.

10. The acoustical transmitting system of claim 9 wherein the low frequency range of the transmitting system extends below approximately 1000 Hertz, and the band-pass filter in said low frequency channel is centered at approximately 525 Hertz.

11. The acoustical transmitting system of claim 8 wherein the low frequency channel of said input signal processing circuit further includes all-pass filter means having a center frequency above the predetermined band-pass frequency range of the band-pass filter in said low frequency channel, said all-pass filter means being operative to control the phase of the acoustic energy produced by said second acoustical transducer means relative to the phase of the acoustic energy produced by said first acoustical transducer means within the band-pass frequency range over which said second transducer means operates.

12. A broadband acoustical transmitting system for projecting acoustic energy in a directional polar pattern over an operating frequency range which includes a defined low frequency range and which is driven by and electrical input signal, said acoustical transmitting system comprising a reflector dish having a front concave reflecting surface, a center aperture, and a forward radiant axis extending from said center aperture, a horn-loaded compression driver for producing acoustic energy within the operating frequency range of the transmitting system, said compression driver being mounted in front of and in spaced relation to the concave reflecting surface of said reflector dish, and further being positioned substantially on the forward radiant axis of said reflecting surface, so as to direct acoustic energy produced thereby toward said reflecting surface, and said driver having a characteristic amplitude and phase response, said reflecting surface being operative to reflect acoustic energy received from said horn-loaded compression driver in a directional polar pattern about said forward radiant axis, and a low frequency driver mounted behind the center aperture of said reflector dish for producing acoustic energy which is emitted from the aperture therein in a polar pattern about said forward radiant axis and which combines and interacts with the acoustic energy produced by said compression driver to produce a composite polar pattern about the dish's forward radiant axis, said low frequency driver having a characteristic amplitude and phase response, an input signal processing circuit including a high frequency channel connected to said horn-loaded compression driver and a low frequency channel connected to said low frequency driver, the high frequency channel of said signal processing circuit including high-pass filter means for rolling off the amplitude response of said compression driver at a predetermined rate within the low frequency range of the transmitting system, the low frequency channel of said signal processing circuit including band-pass filter means for limiting the amplitude response of said low frequency driver to a predetermined band-pass frequency range within the low frequency range of said transmitting system such that the low frequency driver effectively operates within said band-pass frequency range, and all-pass filter means having a center frequency above the predetermined band-pass frequency range over which the low frequency driver operates, said all-pass filter means being operative to control the phase of the acoustic energy produced by said low frequency driver relative to the phase of the acoustic energy produced by said horn-loaded compression driver within said band-pass frequency range, said input signal processing means being operative to control the acoustic energies produced by said horn-loaded compression driver and said low frequency driver such that they combine and interact within the band-pass frequency range over which said low frequency driver operates to enhance the directionality of the composite polar pattern of the transmitting system.

13. The acoustical transmitting system of claim 12 wherein the band-pass filter means in the low frequency channel of said signal processing circuit limits the band-pass frequency range over which said low frequency driver operates to less than approximately one-half octave centered at a frequency within the low frequency range of the transmitting system.

14. A broadband acoustical transmitting system for projecting acoustic energy in a directional polar pattern over an operating frequency range which includes a defined low frequency range and which is driven by and electrical input signal, said acoustical transmitting system comprising a reflector dish having a front concave reflecting surface and a forward radiant axis, first acoustical transducer means for producing acoustic energy within the operating frequency range of the transmitting system, said first acoustical transducer means being operatively positioned in spaced relation in front of the concave reflecting surface of said reflector dish for directing acoustic energy produced thereby toward said reflecting surface, said first transducer means having a characteristic amplitude and phase response, and said reflecting surface being operative to reflect acoustic energy received from said first acoustical transducer means in a directional polar pattern about said radiant axis, second acoustical transducer means having a characteristic amplitude and phase response and operative to produce acoustic energy from a position in close proximity to said reflector dish which causes the acoustic energy generated thereby to radiate from the reflecting surface of said dish in a polar pattern about said radiant axis and which results in an acoustic path length difference between the acoustic energy produced by said first transducer means and the acoustic energy produced by said second transducer means at any point in front of said reflector dish, an input signal processing circuit including a low frequency channel connected to said second transducer means and a band-pass filter means in said low frequency channel for limiting the amplitude response of said second transducer means to a predetermined band-pass frequency range within the low frequency range of said acoustical transmitting system.

15. A method of projecting acoustic energy from a reflector dish having a concave reflecting surface and a forward radiant axis, and wherein acoustic energy is projected from said reflector dish in a directional polar pattern over a desired frequency range which includes a defined low frequency range, which method comprises producing acoustic energy within the desired operating frequency range at a first position in front of the concave reflecting surface of the reflector dish, directing the acoustic energy from said first position toward said concave reflecting surface such that said acoustic energy is reflected by said reflecting surface in a directional polar pattern about the forward radiant axis of the reflector dish, producing acoustic energy in the low frequency range of said desired operating frequency range at a second position located substantially at the reflecting surface of said reflector dish such that the acoustic energy produced at said second position is emitted from said reflecting surface in a polar pattern about the forward radiant axis of said reflector dish, and controlling the phase and amplitude of the acoustic energies produced at said first and second positions such that they combine and interact to produce an enhanced directional polar pattern about said radiant axis within the low frequency range of the desired operating frequency range.

16. The method of claim 15 wherein the step of controlling the phase and amplitude of the acoustic energies produced at said first and second positions includes limiting the amplitude of the acoustic energy produced at said second position to a band-pass frequency range of less than approximately one-half octave centered within the low frequency range of said desired operating frequency range.

17. The method of claim 16 wherein the step of controlling the phase and amplitude of the acoustic energies produced at said first and second positions includes rolling off the amplitude of the acoustic energy produced at said first position at a predetermined rate within the low frequency range of the desired operating frequency range.

18. The method of claim 17 wherein the amplitude of the acoustic energy produced at said first position is rolled off at a rate of 12 dB/octave.

19. A method of projecting acoustic energy from a reflector dish having a concave reflecting surface and a forward radiant axis, and wherein acoustic energy is projected from said reflector dish in a directional polar pattern over a desired operating frequency range which includes a defined low frequency range, which method comprises producing acoustic energy within the desired operating frequency range at a first position in front of the concave reflecting surface of the reflector dish, directing the acoustic energy from said first position toward said concave reflecting surface such that said acoustic energy is reflected by said reflecting surface in a directional polar pattern about the forward radiant axis of the reflector dish, producing acoustic energy in the low frequency range of said operating frequency range at a second position relative to the reflecting surface of said reflector dish such that the acoustic energy produced from said second position is directed from said dish in a polar pattern about the dish's forward radiant axis, said second position for producing acoustic energy being chosen such that an acoustic path length difference exists between the acoustic energy produced at said first position and the acoustic energy produced at said second position at any point in front of said reflector dish, and controlling the phase and amplitude of the acoustic energies produced at said first and second positions such that within the low frequency range of the desired operating frequency range such acoustic energies combine to produce gain on the forward radiant axis of said reflector dish and cancellations at positions off said radiant axis.

* * * * *